US007628508B2

(12) United States Patent
Kita et al.

(10) Patent No.: US 7,628,508 B2
(45) Date of Patent: Dec. 8, 2009

(54) ILLUMINATING DEVICE

(75) Inventors: Yasushi Kita, Tokyo (JP); Shinichi Kojima, Tokyo (JP); Takako Minoda, Tokyo (JP); Naoko Takenobu, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 251 days.

(21) Appl. No.: 11/860,802

(22) Filed: Sep. 25, 2007

(65) Prior Publication Data

US 2008/0080178 A1 Apr. 3, 2008

(30) Foreign Application Priority Data

Oct. 3, 2006 (JP) ..... 2006-271518

(51) Int. Cl.
*F21V 13/04* (2006.01)
*F21V 21/10* (2006.01)

(52) U.S. Cl. ..... 362/231; 362/240; 362/431

(58) Field of Classification Search ..... 362/231, 362/249.02, 431, 240, 559, 153, 153.1, 227, 362/230, 234, 800
See application file for complete search history.

(56) References Cited

U.S. PATENT DOCUMENTS 4,651,260 A * 3/1987 Lasker ..... 362/281
4,701,832 A * 10/1987 Lasker ..... 362/281
6,250,774 B1 * 6/2001 Begemann et al. ..... 362/231
6,942,361 B1 * 9/2005 Kishimura et al. ..... 362/240

FOREIGN PATENT DOCUMENTS

JP 2005-158540 6/2005

* cited by examiner

*Primary Examiner*—Bao Q Truong
(74) *Attorney, Agent, or Firm*—Rankin, Hill & Clark LLP

(57) ABSTRACT

An illuminating device able to easily visualize a pedestrian, etc. on a footway by the driver of an automobile is provided. The illuminating device has a footway side light source portion for irradiating light of spectral characteristics rich in blue-green color light to the footway, and a roadway side light source portion for irradiating light of spectral characteristics rich in green-red color light to a roadway. Further, the spectral characteristics of the light irradiated from the footway side light source portion are set such that a value $I_p$ obtained by the following formula (1) is greater than a value $I_C$ obtained by the following formula (1) from the spectral characteristics of the light irradiated from the roadway side light source portion.

$$I = \frac{\int_a^b S(\lambda)\cdot V'(\lambda)\,d\lambda}{\int_{380}^{780} S(\lambda)\cdot V(\lambda)\,d\lambda} \quad (1)$$

10 Claims, 7 Drawing Sheets

ILLUMINATING DEVICE

BACKGROUND OF THE INVENTION

1. Field of the Invention

The present invention relates to an illuminating device arranged in a street having a roadway and a footway and illuminating the roadway and the footway.

2. Background Art

An illuminating device for an intersecting point is formerly known as the illuminating device for illuminating the street (e.g., see Japanese Patent Laid-Open No. 2005-158540). This illuminating device has a light source and a reflecting mirror of a special shape arranged in an upper portion of the light source. The reflecting mirror is constructed so as to project irradiation light for directing light of the light source to a central portion of the intersecting point, irradiation light for directing this light onto a close pedestrian crossing, and irradiation light for illuminating a rear area. Thus, illuminance deficiency near the center of the intersecting point, a pedestrian crossing portion and a crossing standby portion of the footway is dissolved, and a driver of an automobile precisely and easily confirms a situation of the intersecting point.

However, in the former illuminating device, there is a case difficult for the driver of the automobile to visualize a pedestrian, etc. on the footway even when light of appropriate illuminance is illuminated to the footway. It is considered that this is caused by visual characteristics of a human being. When it is late that the driver of the automobile finds the pedestrian, etc. on the footway, there is also a fear that coping of the driver with respect to flying-out of the pedestrian, etc. to the roadway is late.

SUMMARY OF THE INVENTION

An object of the present invention is to provide an illuminating device in which the driver of the automobile can easily visualize the pedestrian, etc. on the footway.

Therefore, the present invention resides in an illuminating device arranged in a street having a roadway and a footway and illuminating the roadway and the footway, wherein the illuminating device comprises a footway side light source portion for irradiating light of spectral characteristics rich in blue-green color light to the footway; and a roadway side light source portion for irradiating light of spectral characteristics rich in green-red color light to the roadway.

The present invention also resides in an illuminating device arranged in a street having a roadway and a footway and illuminating the roadway and the footway, wherein the illuminating device comprises a roadway side light source portion for illuminating the roadway; and a footway side light source portion for illuminating the footway; and spectral characteristics of the light irradiated from the footway side light source portion are set such that a value $I_p$ obtained by the following formula (1) is greater than a value $I_C$ obtained by the following formula (1) from spectral characteristics of the light irradiated from the roadway side light source portion, $$I = \frac{\int_a^b S(\lambda)\cdot V'(\lambda)\,d\lambda}{\int_{380}^{780} S(\lambda)\cdot V(\lambda)\,d\lambda} \quad (1)$$

where a to b is a wavelength area of blue-green color light, $S(\lambda)$ is spectral radiant intensity of wavelength $\lambda$, $V(\lambda)$ is photopic vision visual spectral sensitivity, and $V'(\lambda)$ is scotopic vision visual spectral sensitivity.

A visual cell on a retina of a human being is constructed by a cone and a rod. The cone has a function for discriminating a color under a light situation (photopic vision). The rod has a function for discriminating light and darkness under a dark situation (scotopic vision). As shown by V within FIG. 3, when wavelength $\lambda$ is 555 nm, i.e., at the time of green light of a yellow light side, there is a peak of visual sensitivity using the cone. As shown by V' within FIG. 3, when wavelength $\lambda$ is 507 nm, i.e., at the time of green light of a blue light side, there is a peak of visual sensitivity using the rod. Accordingly, it is understood that the peak of the visual sensitivity in the scotopic vision for actively operating the rod is shifted on a short wavelength side (blue light side) by about 50 nm from the peak of the visual sensitivity in the photopic vision for actively operating the cone.

In an automobile driving environment of nighttime, it corresponds to mesopic vision as an intermediate state of the scotopic vision and the photopic vision. Therefore, it lies under a condition in which the rod is also actively operated as well as the cone.

As shown in FIG. 4, the cone is concentrated onto the center of the retina, and is extremely reduced when it is separated from the center. In contrast to this, the rod does not exist at the center of the retina, and is suddenly increased when it is separated from the center. Accordingly, the cone for discriminating a color is actively operated in central vision of a visual field of a driver of an automobile, and is almost not operated in peripheral vision. In contrast to this, the rod for discriminating light and darkness is actively operated in the peripheral vision. As can be clearly seen from FIGS. 4 and 5, the driver of the automobile visualizes the footway side of a street by the peripheral vision in many cases.

In accordance with the above illuminating device of the present invention, the footway is illuminated by light of spectral characteristics high in spectral radiant intensity near 507 nm (blue-green color light) by the footway side light source portion. Therefore, the driver of the automobile can easily visualize a pedestrian, etc. on the footway by the rod.

In the illuminating device of the present invention, it is preferable that value a of the above formula (1) is set to 450 nm, and value b is set to 550 nm. The driver of the automobile more clearly and easily visualizes the pedestrian, etc. on the footway by the rod by using a light source of spectral characteristics high in spectral radiant intensity in the wavelength area of 450 to 550 nm as the light source of the footway side light source portion in comparison with the light source of the roadway side light source portion.

The driver of the automobile can more clearly visualize the pedestrian, etc. on the footway by increasing the above value $I_P$ until a degree able to sense a difference clearer in brightness than the above value $I_C$ by the driver of the automobile. Therefore, an experiment for comparing a sensing way of brightness of a street illuminated by the light source is made by adjusting an output using the light source of a different kind. As a result, it has been found that the difference (the difference between the above value $I_P$ of the footway side light source portion and the above value $I_C$ of the roadway side light source portion) of value I of the above formula (1) is required by 30 percent or more so as to sense a luminance difference of 10 percent or more said as a clear difference in brightness in the scotopic vision by a human being.

FIG. 6 is a graph showing a result in which the output of the light source is adjusted by using plural light sources different in the above value I such that a subject senses the brightness of a street illuminated by the light source in the scotopic vision as equal brightness, and the luminance of the street illuminated by the light source at that time is measured. In FIG. 6, the abscissa axis is set to "value I obtained by the above formula (1) from the spectral characteristics of the light source", and the ordinate axis is set to "a luminance difference which is provided by subtracting the luminance of the light source (■) as a reference from the luminance of another light source and is shown by percentage with respect to the light source (■) as a reference". As can be seen from FIG. 6, as value I is raised in the scotopic vision, a human being can sense equal brightness at a small luminance.

In the illuminating device arranged in the street, it is required that the luminance of the street irradiated by light is uniform. Therefore, it is necessary to set both the light source portions such that the luminance of the roadway illuminated by the roadway side light source portion and the luminance of the footway illuminated by the footway side light source portion are equal.

As can be seen from FIG. 6, when both the light source portions are set such that the luminances of the roadway and the footway are equal, the human being senses that the footway illuminated by the footway side light source portion large in value I is brighter. For example, when the light source (■) is used as the light source of the roadway side light source portion and the light source (□) is used as the light source of the footway side light source portion as shown in FIG. 6, the output of the light source (□) of the footway side light source portion is raised such that the luminance of the footway illuminated by the light source (□) of the footway side light source portion is equal to the luminance of the roadway illuminated by the light source (■) of the roadway side light source portion.

Thus, it is understood that the human being brightly senses the footway illuminated by the light source (□) of the footway side light source portion in comparison with the roadway, and senses the brightness such that luminance is increased by about 10 percent able to sense a clear difference in brightness by the human being as can be seen from FIG. 6. It is also understood from FIG. 6 that the value I of the light source (□) of the footway side light source portion at this time is greater by about 30 percent than the value I of the light source (■) of the roadway side light source portion.

Accordingly, in the illuminating device of the present invention, it is preferable that the above value $I_P$ of the spectral characteristics of light irradiated from the footway side light source portion is set to be great by about 30 percent or more in comparison with the above value $I_C$ of the spectral characteristics of light irradiated from the above roadway side light source portion. Thus, the driver of an automobile can more clearly visualize a pedestrian, etc. on the footway.

The footway light source portion and the roadway light source portion have a plurality of short wavelength color light sources for emitting light including at least blue light or green light, and a plurality of long wavelength color light sources for emitting light including at least yellow light or red light as light sources; and the illuminating device further comprises an output adjusting means for adjusting an output of each light source so as to relatively raise the output of the short wavelength color light source in comparison with the output of the long wavelength color light source in the footway side light source portion, and relatively raise the output of the long wavelength color light source in comparison with the output of the short wavelength color light source in the roadway side light source portion.

In accordance with such a construction, the spectral characteristics of each light source portion can be adjusted in conformity with an environment of an arranging place of the illuminating device, etc. by the above output adjusting means. Therefore, light suitable for the environment of the arranging place of the illuminating device, etc. can be irradiated to a street without changing the light source.

DESCRIPTION OF THE PREFERRED EMBODIMENTS

Figure 1:
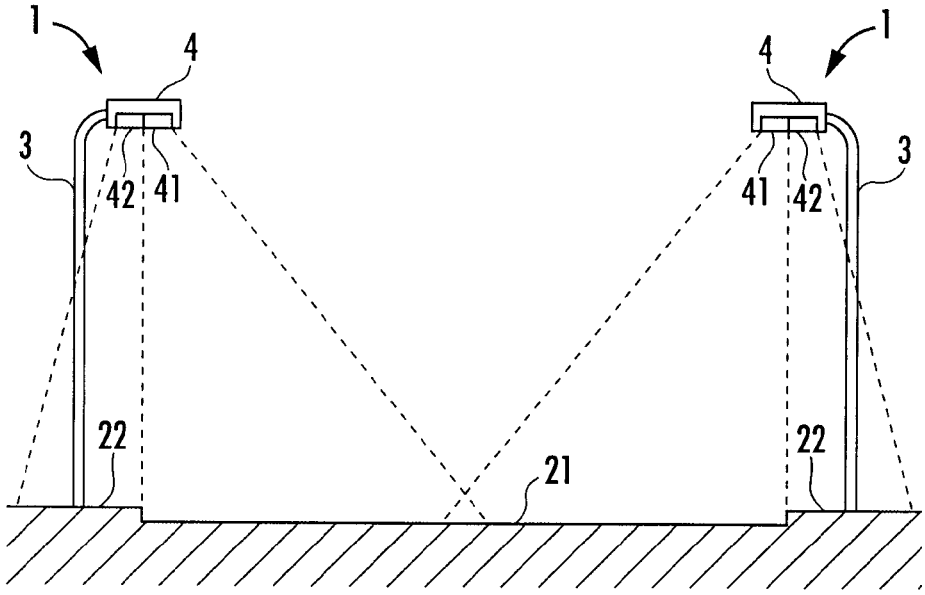
FIG. 1 is an explanatory view showing an illuminating device of a first embodiment of the present invention.

As shown in FIG. 1, an illuminating device 1 of a first embodiment of the present invention is arranged in a street 2 having a roadway 21 and a footway 22. The illuminating device 1 is constructed by a support portion 3 extending from the footway 22 in a vertical direction, and an illuminating main body 4 arranged at an upper end of the support portion 3. The illuminating main body 4 has a roadway side light source portion 41 for irradiating light to the roadway 21, and a footway side light source portion 42 for irradiating light to the footway 22.

Figure 2:
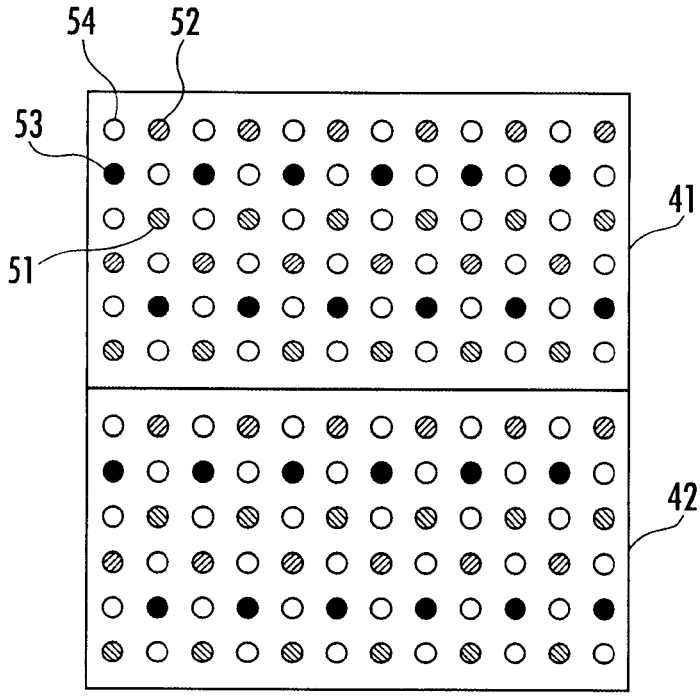
FIG. 2 is an explanatory view showing a roadway side light source portion and a footway side light source portion of the first embodiment.

As shown in FIG. 2, each of light sources of both the light source portions 41, 42 is constructed by arraying plural LEDs 51 to 54 of the four colors of red, green, blue and yellow (or white) colors. The respective LEDs 51 to 54 are dispersively arranged in preferable balance in both the light source portions 41, 42 such that a ratio of red LED 51, green LED 52, blue LED 53 and yellow (white) LED 54 becomes a ratio of 1:1:1:3.

Further, the illuminating main body 4 has an unillustrated output adjusting means for separately adjusting outputs of the respective LEDs 51 to 54 every light source portion. This output adjusting means is constructed by an electronic device such as a microcomputer, etc., and is connected to each of the LEDs 51 to 54. This output adjusting means sets the outputs of the respective LEDs 51 to 54 so as to relatively strengthen the outputs of short wavelength LEDs of green LED 52 and blue LED 53 with respect to the outputs of long wavelength LEDs of red LED 51 and yellow LED 54 in the footway side light source portion 42. Conversely, in the roadway side light source portion 41, the output adjusting means sets the outputs of the respective LEDs 51 to 54 so as to relatively strengthen the outputs of long wavelength LEDs of red LED 51 and yellow LED 54 with respect to the outputs of short wavelength LEDs of green LED 52 and blue LED 53. Namely, the spectral characteristics of light synthesized by the respective LEDs 51 to 54 of the footway side light source portion 42 become rich in blue-green light, and the spectral characteristics of light synthesized by the respective LEDs 51 to 54 of the roadway side light source portion 41 become rich in green-red light by the output adjusting means.

In the first embodiment, the short wavelength LEDs of green LED 52 and blue LED 53 correspond to "a short wavelength color light source for emitting light including at least blue light or green light", and the long wavelength LEDs of red LED 51 and yellow LED 54 correspond to "a long wavelength color light source for emitting light including at least yellow light or red light". The output of the white LED may not be adjusted by the output adjusting means.

Concretely, the outputs of the respective LEDs 51 to 54 are adjusted by the above output adjusting means such that a value $I_P$ obtained by the following formula (2) in the spectral characteristics of light irradiated from the footway side light source portion 42, i.e., the synthesized light of each of the LEDs 51 to 54 of the footway side light source portion 42 is greater than a value $I_C$ obtained by the following formula (2) of the spectral characteristics of light irradiated from the roadway side light source portion 41, i.e., the synthesized light of each of the LEDs 51 to 54 of the roadway side light source portion 41.

$$I = \frac{\int_{450}^{550} S(\lambda) \cdot V'(\lambda)\, d\lambda}{\int_{380}^{780} S(\lambda) \cdot V(\lambda)\, d\lambda} \tag{2}$$

In formula (2), $S(\lambda)$ is spectral radiant intensity of wavelength $\lambda$, $V(\lambda)$ is photopic vision visual spectral sensitivity, and $V'(\lambda)$ is scotopic vision visual spectral sensitivity.

A wavelength area of blue-green light is mainly set to 430 to 570 nm although there is an individual difference. As an experimental result, it has been found that a driver of an automobile can clearly visualize a pedestrian, etc. on the footway 22 by raising the spectral radiant intensity at particularly, 450 to 550 nm within this wavelength area of the blue-green light. Accordingly, in the above formula (2), the integrating wavelength area of a numerator side is set to 450 to 550 nm.

Figure 3:
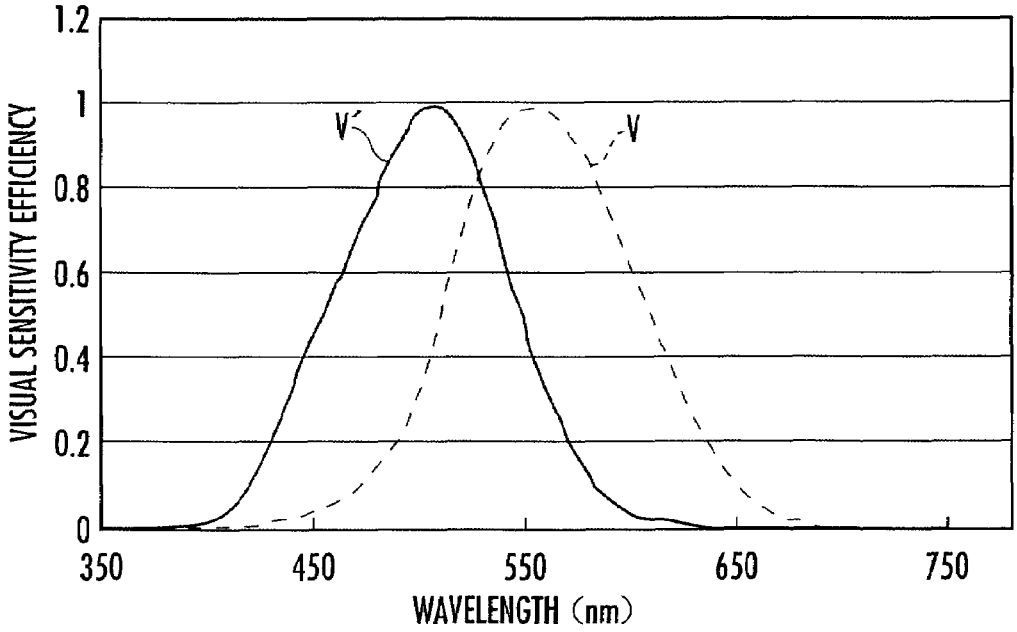
FIG. 3 is a graph showing visual sensitivities of a cone and a rod.

Here, a visual cell on a retina of a human being is constructed by a cone and a rod. The cone manages a function for discriminating a color under a light situation (photopic vision). The rod manages a function for discriminating light and darkness under a dark situation (scotopic vision). As shown by V within FIG. 3, there is a peak of visual sensitivity provided by the cone when wavelength $\lambda$ is 555 nm, i.e., at the time of green light of a yellow light side. As shown by V' within FIG. 3, there is a peak of visual sensitivity provided by the rod when wavelength $\lambda$ is 507 nm, i.e., at the time of green light of a blue light side. Accordingly, it is understood that the peak of visual sensitivity in the scotopic vision for actively operating the rod is shifted on a short wavelength side by about 50 nm from the peak of visual sensitivity in the photopic vision for actively operating the cone.

Further, in an automobile driving environment of nighttime, it corresponds to mesopic vision as an intermediate state of the scotopic vision and the photopic vision. Therefore, it lies under a condition in which the rod is also actively operated as well as the cone.

Figure 4:
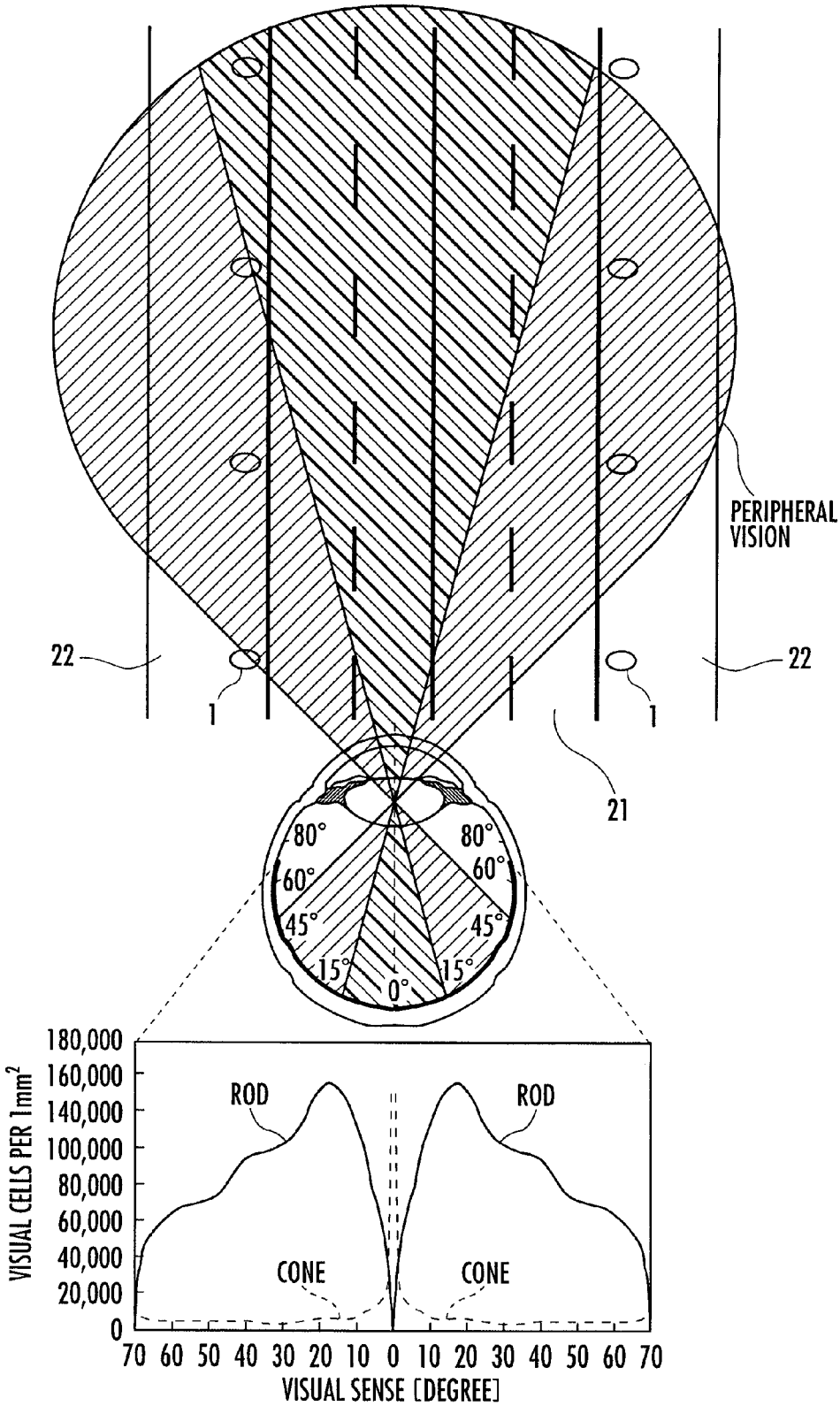
FIG. 4 is an explanatory view showing a distribution and a visual angle of the cone and the rod on a retina.
Figure 5:
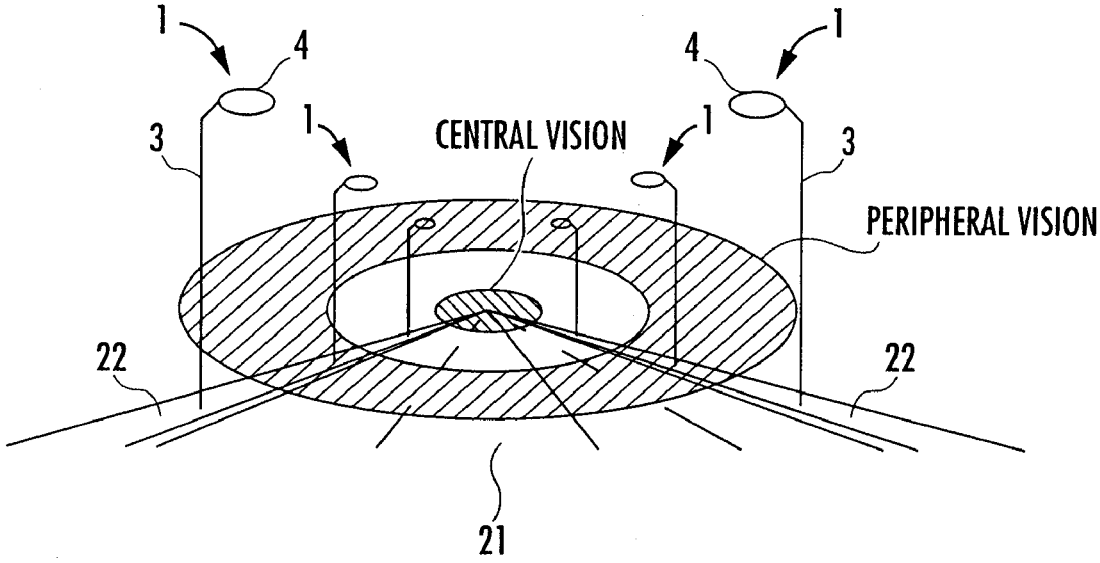
FIG. 5 is an explanatory view showing a visual field range of a driver of an automobile.

As shown in FIG. 4, the cone is concentrated onto the center of the retina, and is extremely reduced when it is separated from the center. In contrast to this, the rod does not exist at the center of the retina, and is suddenly increased when it is separated from the center. Accordingly, the cone for discriminating a color is actively operated in central vision of the visual field of a driver, and is almost not operated in peripheral vision. In contrast to this, the rod for discriminating light and darkness is actively operated in the peripheral vision. As clearly seen from FIGS. 4 and 5, the driver of the automobile often visualizes the footway side of a street by the peripheral vision.

In accordance with the illuminating device 1 of the first embodiment, the footway side light source portion 42 illuminates the footway 22 by light of spectral characteristics high in spectral radiant intensity of a wavelength area of blue-green light, particularly, 450 to 550 nm so that the footway 22 is illuminated by light of spectral characteristics high in spectral radiant intensity near 507 nm as a peak of the visual sensitivity of the rod. Therefore, the driver of the automobile can easily visualize a pedestrian by the rod.

Further, the driver of the automobile can more clearly visualize the pedestrian, etc. on the footway by increasing the above value $I_P$ from the above value $I_C$ until a degree able to sense a clear difference in brightness by the driver of the automobile. Therefore, an experiment for comparing a sensing way of brightness of a street illuminated by the light source is made by adjusting an output by using the light source of a different kind. As a result, it has been found that the difference (the difference between the above value $I_P$ of the footway side light source portion 42 and the above value $I_C$ of the roadway side light source portion 41) of value I of the above formula (2) is required by 30 percent or more to be able to sense a luminance difference of 10 percent or more said as a clear difference in brightness in the scotopic vision by a human being.

Figure 6:
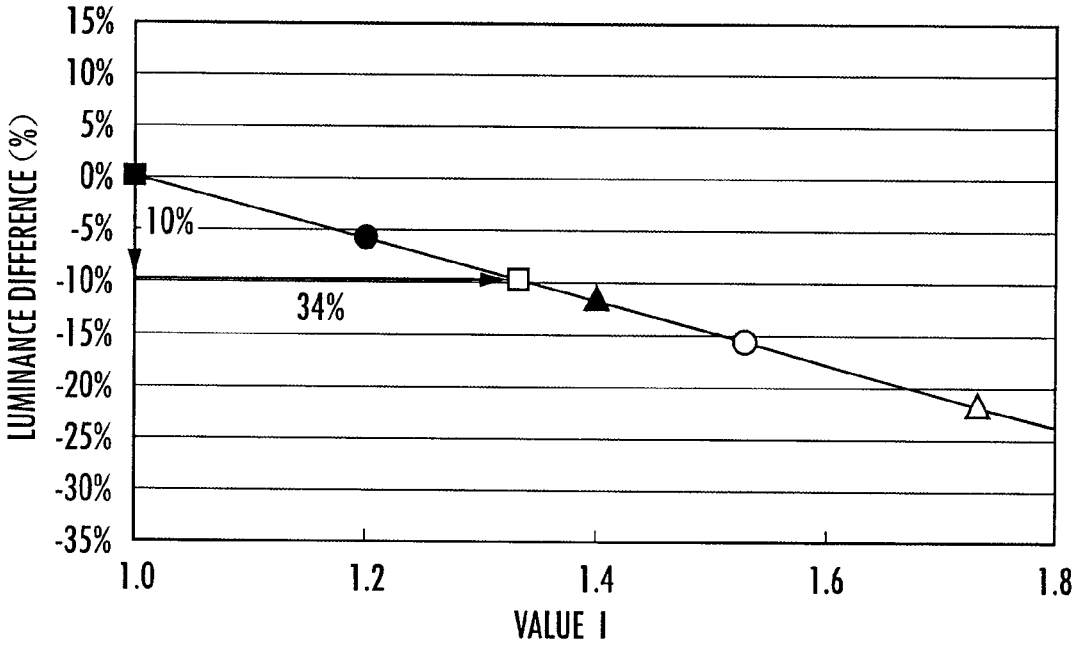
FIG. 6 is a graph showing the relation of a luminance of a light source and value I.

FIG. 6 is a graph showing a result in which plural light sources different in the above value I are used and the output of the light source is adjusted so as to sense the brightness of a street illuminated by the light source in the scotopic vision as equal brightness by a subject, and the luminance of the street illuminated by the light source at that time is measured. In FIG. 6, the abscissa axis is set to "a value I obtained by the above formula (1) from the spectral characteristics of the light source", and the ordinate axis is set to "a luminance difference which is obtained by subtracting the luminance of the light source (■) as a reference from the luminance of another light source and is shown by percentage with respect to the light source (■) as a reference". As can be seen from FIG. 6, a human being can sense equal brightness at a small luminance as the above value I is raised in the scotopic vision.

For the illuminating device arranged in a street, it is required that the luminance of the street irradiated by light is uniform. Therefore, it is necessary to set both the light source portions 41, 42 such that the luminance of the roadway 21 irradiated by the roadway side light source portion 41 and the luminance of the footway 22 irradiated by the footway side light source portion 42 are equal.

As can be seen from FIG. 6, when the luminances of the roadway 21 and the footway 22 are set to be equal, the human being brightly senses the footway 22 irradiated by the footway side light source portion 42 large in value I in comparison with the roadway 21. For example, when a light source (■) is used as the light source of the roadway side light source portion 41 and a light source (□) is used as the light source of the footway side light source portion 42 as shown in FIG. 6, and an output of the light source (□) of the footway side light source portion 42 is raised such that the luminance of the footway 22 illuminated by the light source (□) of the footway side light source portion 42 is equal to the luminance of the roadway 21 illuminated by the light source (■) of the roadway side light source portion 41, the human being brightly senses the footway 22 illuminated by the light source (□) of the footway side light source portion 42 in comparison with the roadway 21. As can be seen from FIG. 6, it is understood that the human being senses brightness so as to increase luminance by about 10 percent able to sense a clear difference in brightness by the human being. It is also understood from FIG. 6 that value I of the light source (□) of the footway side light source portion 42 at this time is larger by 30 percent than value I of the light source (■) of the roadway side light source portion 41.

Accordingly, it is preferable to set the above value $I_P$ to be greater by 30 percent or more than the above value $I_C$. Thus, the driver of an automobile easily and more clearly visualizes a pedestrian, etc. on the footway 22.

The roadway side light source portion 41 illuminates the roadway 21 by light of spectral characteristics high in spectral radiant intensity of a wavelength area of yellow-red color light. Therefore, the roadway 21 is illuminated by light of spectral characteristics high in spectral radiant intensity near 555 nm as a peak of visual sensitivity of the cone. Therefore, the driver of the automobile can easily visualize another vehicle, etc. on the roadway 21 by the cone.

The illuminating device 1 of the first embodiment irradiates light of spectral characteristics high in spectral radiant intensity in the wavelength area of 450 to 550 nm from an upward direction of the street 2 toward the footway 22. Accordingly, no light irradiated from the footway side light source portion 42 is directly incident to a driver's eye of the automobile running the roadway 21. Therefore, it is possible to avoid a risk that glare is given to the driver of the automobile by the light irradiated from the footway side light source portion 42.

In the first embodiment, both the light source portions 41, 42 are constructed by LEDs 51 to 54 of four colors. Therefore, the spectral characteristics can be adjusted by changing the output of each of the LEDs 51 to 54 of the respective light source portions 41, 42 in conformity with an environment, etc. of an arranging place of the illuminating device 1 by the above output adjusting means. Therefore, light suitable for the environment of the arranging place of the illuminating device 1, etc. can be irradiated to the street 2 without changing the light source.

Figure 7:
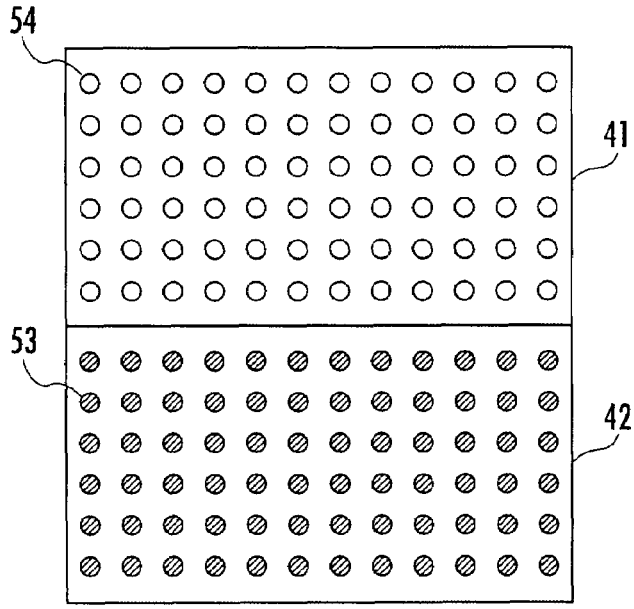
FIG. 7 is an explanatory view showing a roadway side light source portion and a footway side light source portion of a second embodiment of the present invention.

In the first embodiment, the explanation has been made by using the LEDs 51 to 54 of four colors as the light sources of both the light source portions 41, 42. However, the present invention is not limited to this case. For example, as shown as a second embodiment in FIG. 7, a plurality of blue LEDs 53 (or green LEDs 52) may be also used as the light source of the footway side light source portion 42, and a plurality of yellow (white) LEDs 54 may be also used as the light source of the roadway side light source portion 41. A blue fluorescent lamp (or a green fluorescent lamp) may be also used as the light source of the footway side light source portion 42, and a yellow fluorescent lamp (or a white fluorescent lamp) may be also used as the light source of the roadway side light source portion 41.

Figure 8:
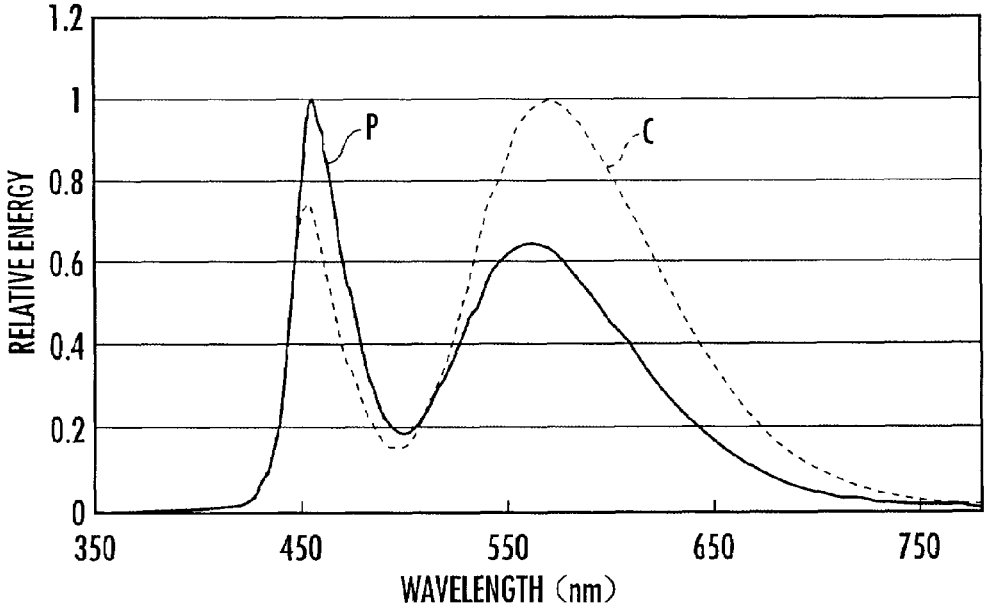
FIG. 8 is a graph showing spectral distributions of both the light source portions of a third embodiment of the present invention.

As a third embodiment, a light source of white light of 5800 K in color temperature may be also used as the light source of the footway side light source portion 42, and a light source of white light of 3800 K in color temperature may be also used as the light source of the roadway side light source portion 41. FIG. 8 shows spectral distributions in this case. In FIG. 8, P shows a spectral distribution of the light source of the footway side light source portion 42, and C shows a spectral distribution of the light source of the roadway side light source portion 41.

In the first embodiment, the spectral characteristics of light irradiated from the footway side light source portion 42 are explained so as to adjust the output of each of the LEDs 51 to 54 by the above output adjusting means such that the value $I_P$ obtained by the above formula (2) is larger than the value $I_C$ obtained by the formula (2) of the spectral characteristics of light irradiated from the roadway side light source portion 41. However, the present invention is not limited to this case. It is sufficient for the footway side light source portion 42 to irradiate light of the spectral characteristics rich in blue-green color light to the footway 22 in comparison with the roadway side light source portion 41.

Figure 9:
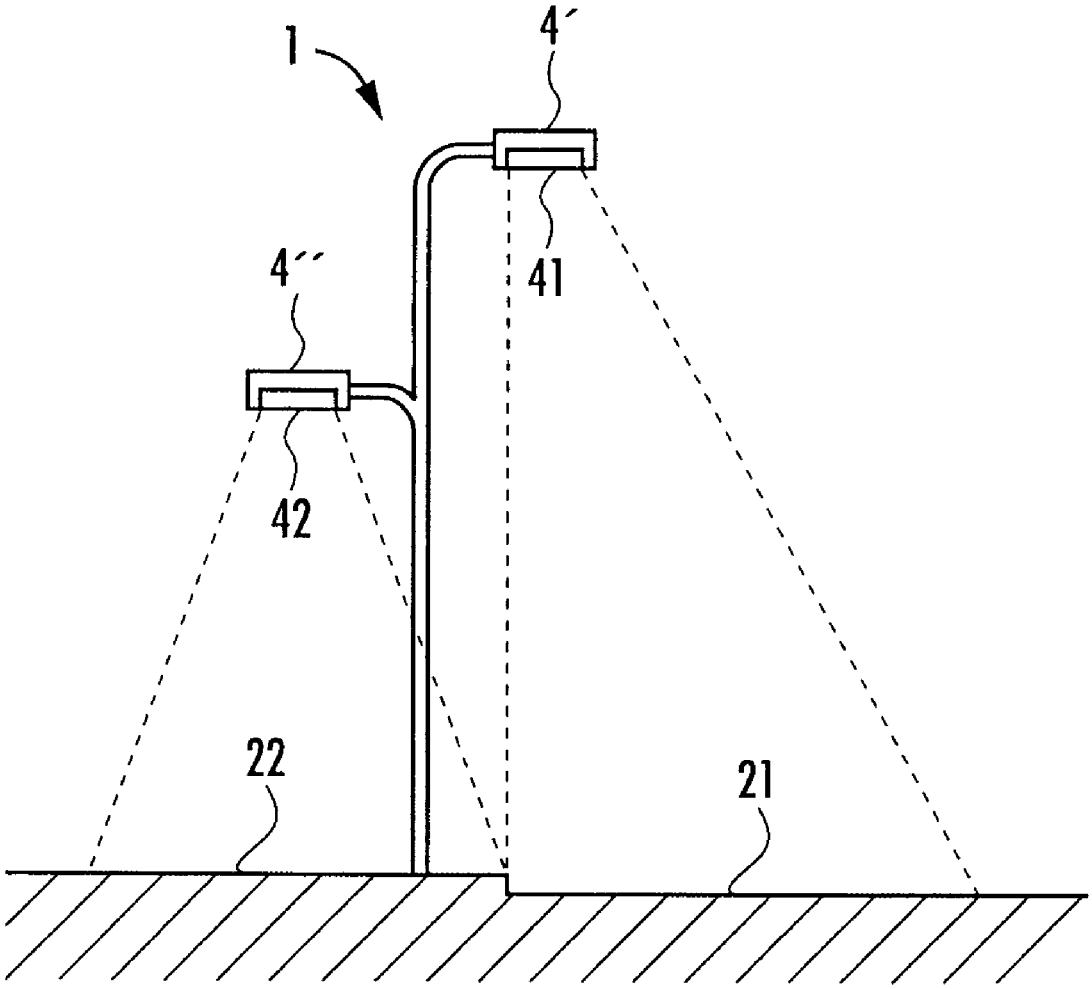
FIG. 9 is an explanatory view showing an illuminating device of a fourth embodiment of the present invention.

As shown as a fourth embodiment in FIG. 9, two separate illuminating main bodies 4', 4" may be also arranged in the support portion 3 of the illuminating device 1, and the roadway side light source portion 41 may be also arranged in the illuminating main body 4', and the footway side light source portion 42 may be also arranged in the illuminating main body 4".

What is claimed is:

1. An illuminating device arranged in a street having a roadway and a footway and illuminating the roadway and the footway, wherein the illuminating device comprises a footway side light source portion for irradiating light of spectral characteristics rich in blue-green color light to said footway; and a roadway side light source portion for irradiating light of spectral characteristics rich in green-red color light to said roadway.

2. The illuminating device according to claim 1, wherein said footway light source portion and said roadway light source portion have a plurality of short wavelength color light sources for emitting light including at least blue light or green light, and a plurality of long wavelength color light sources for emitting light including at least yellow light or red light as light sources; and the illuminating device further comprises an output adjusting means for adjusting an output of each light source so as to relatively raise the output of said short wavelength color light source in comparison with the output of said long wavelength color light source in said footway side light source portion, and relatively raise the output of said long wavelength color light source in comparison with the output of said short wavelength color light source in said roadway side light source portion.

3. An illuminating device arranged in a street having a roadway and a footway and illuminating the roadway and the footway, wherein the illuminating device comprises a roadway side light source portion for illuminating said roadway; and a footway side light source portion for illuminating said footway; and spectral characteristics of the light irradiated from said footway side light source portion are set such that a value $I_p$ obtained by the following formula (1) is greater than a value $I_C$ obtained by the following formula (1) from spectral characteristics of the light irradiated from said roadway side light source portion, $$I = \frac{\int_a^b S(\lambda) \cdot V'(\lambda)\, d\lambda}{\int_{380}^{780} S(\lambda) \cdot V(\lambda)\, d\lambda} \quad (1)$$

where a to b is a wavelength area of blue-green color light, S(λ) is spectral radiant intensity of wavelength λ, V(λ) is photopic vision visual spectral sensitivity, and V'(λ) is scotopic vision visual spectral sensitivity.

4. The illuminating device according to claim 3, wherein the value of a is 450 nm and the value of b is 550 nm in said formula (1).

5. The illuminating device according to claim 3, wherein said value $I_P$ for the spectral characteristic of the light irradiated from said footway side light source portion is larger by 30 percent or more in comparison with said value $I_C$ for the spectral characteristic of the light irradiated from said roadway side light source portion.

6. The illuminating device according to claim 4, wherein said value $I_P$ for the spectral characteristic of the light irradiated from said footway side light source portion is larger by 30 percent or more in comparison with said value $I_C$ for the spectral characteristic of the light irradiated from said roadway side light source portion.

7. The illuminating device according to claim 3, wherein said footway light source portion and said roadway light source portion have a plurality of short wavelength color light sources for emitting light including at least blue light or green light, and a plurality of long wavelength color light sources for emitting light including at least yellow light or red light as light sources; and the illuminating device further comprises an output adjusting means for adjusting an output of each light source so as to relatively raise the output of said short wavelength color light source in comparison with the output of said long wavelength color light source in said footway side light source portion, and relatively raise the output of said long wavelength color light source in comparison with the output of said short wavelength color light source in said roadway side light source portion.

8. The illuminating device according to claim 4, wherein said footway light source portion and said roadway light source portion have a plurality of short wavelength color light sources for emitting light including at least blue light or green light, and a plurality of long wavelength color light sources for emitting light including at least yellow light or red light as light sources; and the illuminating device further comprises an output adjusting means for adjusting an output of each light source so as to relatively raise the output of said short wavelength color light source in comparison with the output of said long wavelength color light source in said footway side light source portion, and relatively raise the output of said long wavelength color light source in comparison with the output of said short wavelength color light source in said roadway side light source portion.

9. The illuminating device according to claim 5, wherein said footway light source portion and said roadway light source portion have a plurality of short wavelength color light sources for emitting light including at least blue light or green light, and a plurality of long wavelength color light sources for emitting light including at least yellow light or red light as light sources; and the illuminating device further comprises an output adjusting means for adjusting an output of each light source so as to relatively raise the output of said short wavelength color light source in comparison with the output of said long wavelength color light source in said footway side light source portion, and relatively raise the output of said long wavelength color light source in comparison with the output of said short wavelength color light source in said roadway side light source portion.

10. The illuminating device according to claim 6, wherein said footway light source portion and said roadway light source portion have a plurality of short wavelength color light sources for emitting light including at least blue light or green light, and a plurality of long wavelength color light sources for emitting light including at least yellow light or red light as light sources; and the illuminating device further comprises an output adjusting means for adjusting an output of each light source so as to relatively raise the output of said short wavelength color light source in comparison with the output of said long wavelength color light source in said footway side light source portion, and relatively raise the output of said long wavelength color light source in comparison with the output of said short wavelength color light source in said roadway side light source portion.

* * * * *